US010024246B2

(12) United States Patent
Rammer et al.

(10) Patent No.: US 10,024,246 B2
(45) Date of Patent: Jul. 17, 2018

(54) METHOD FOR CONTROLLING AN ENGINE BRAKING DEVICE AND ENGINE BRAKING DEVICE

(71) Applicant: MAN Truck & Bus Österreich AG, Steyr (AT)

(72) Inventors: Franz Rammer, Wolfern (AT); André Kreuzriegler, Reichraming (AT)

(73) Assignee: MAN TRUCK & BUS OESTERREICH AG, Steyr (AT)

( * ) Notice: Subject to any disclaimer, the term of this patent is extended or adjusted under 35 U.S.C. 154(b) by 0 days.

(21) Appl. No.: 14/966,375

(22) Filed: Dec. 11, 2015

(65) Prior Publication Data

US 2016/0169126 A1 Jun. 16, 2016

(30) Foreign Application Priority Data

Dec. 15, 2014 (AT) ..... A 909/2014

(51) Int. Cl.
*F02D 13/04* (2006.01)
*F02D 9/06* (2006.01)
*F01L 13/06* (2006.01)

(52) U.S. Cl.
CPC ..... *F02D 13/04* (2013.01); *F01L 13/06* (2013.01); *F02D 9/06* (2013.01)

(58) Field of Classification Search
CPC ..... F02D 13/04; F02D 9/06; F01L 13/06
USPC ..... 123/320
See application file for complete search history.

(56) References Cited

U.S. PATENT DOCUMENTS 4,501,240 A * 2/1985 Aono ..... F02D 31/001 123/339.12
5,150,678 A 9/1992 Wittmann
5,634,447 A * 6/1997 Rowells ..... F01L 13/06 123/322
6,336,447 B1 * 1/2002 Bartel ..... F02B 33/44 123/559.1
7,523,736 B2 4/2009 Rammer
8,225,769 B2 7/2012 Dilly
(Continued)

FOREIGN PATENT DOCUMENTS

DE 4425956 A1 1/1996
EP 0407842 A1 1/1991
(Continued)

*Primary Examiner* — Joseph Dallo
*Assistant Examiner* — Yi-Kai Wang
(74) *Attorney, Agent, or Firm* — Lucas & Mercanti, LLP

(57) ABSTRACT

The invention relates to a method for controlling an engine braking device for a combustion engine in motor vehicles, in particular in commercial vehicles, which has an intake system, an exhaust system, gas exchange valves associated with the combustion engine, a fuel injection device, which injects fuel into at least one combustion chamber, an exhaust turbocharger integrated into the exhaust system and the intake system, and an engine braking unit, wherein the engine braking unit has a decompression brake, which influences at least one outlet valve of the gas exchange valves, and a brake flap, which is arranged in the exhaust system and causes the exhaust gas to build up. According to the invention, as engine braking starts or during engine braking, fuel is injected into at least one combustion chamber of the combustion engine for a predefined period of time.

15 Claims, 2 Drawing Sheets

(56) References Cited

U.S. PATENT DOCUMENTS

| | | | | |
|---|---|---|---|---|
| 2005/0098146 | A1* | 5/2005 | Lee | F02D 23/02 123/305 |
| 2006/0185656 | A1* | 8/2006 | Miyauchi | F02D 41/1475 123/674 |
| 2006/0249120 | A1* | 11/2006 | Semii | F02D 41/062 123/446 |
| 2009/0193790 | A1 | 8/2009 | Richter et al. | |
| 2012/0234294 | A1* | 9/2012 | Nakamura | F02D 9/06 123/436 |
| 2013/0179050 | A1* | 7/2013 | Munshi | F02B 43/10 701/104 |
| 2013/0276756 | A1* | 10/2013 | Leone | F02D 41/064 123/445 |
| 2014/0214308 | A1* | 7/2014 | Mulloy | F02D 9/06 701/110 |
| 2016/0123242 | A1* | 5/2016 | Hamilton | F02D 41/12 123/324 |

FOREIGN PATENT DOCUMENTS

| | | | |
|---|---|---|---|
| EP | 1162356 | A2 | 12/2001 |
| EP | 1801392 | A2 | 6/2007 |
| EP | 2038296 | A2 | 8/2009 |
| WO | 2014193349 | A1 | 12/2014 |

* cited by examiner

METHOD FOR CONTROLLING AN ENGINE BRAKING DEVICE AND ENGINE BRAKING DEVICE

CROSS-REFERENCE TO RELATED APPLICATIONS

The present application claims priority of A 909/2014 filed Dec. 15, 2014, which is incorporated herein by reference.

BACKGROUND OF THE INVENTION

The present invention relates to a method for controlling an engine braking device for a combustion engine in motor vehicles, in particular in commercial vehicles, to an engine braking device and to a vehicle having the engine braking device.

In air-compressing (diesel) combustion engines in commercial vehicles, there is a known practice of producing an exhaust gas backpressure in the exhaust system using a brake flap in the overrun mode, the backpressure bringing about effective engine braking since the pistons of the combustion engine operate against this exhaust gas pressure during the exhaust stroke (outlet valves open).

In order significantly to increase the effect of such an engine braking device, there is a practice, known from U.S. Pat. No. 5,150,678 for example, of additionally providing a decompression brake, where, in addition to regular valve actuation in accordance with the four-stroke principle, the outlet valves are also partially open during the compression stroke. Here, the additional braking effect arises from the throttled discharge of the combustion air into the exhaust system.

The decompression brake can be either exhaust-controlled or positively controlled. In exhaust-controlled operation, the valve timing of the outlet valves is configured in such a way that the outlet valves open irregularly in a specifically intended manner owing to the exhaust gas backpressure present when the brake flap is closed ("valve jumping") and are held open by a mechanism until the next regular valve opening.

In the case of a positively controlled decompression brake, interventions are generally made into the regular valve timing by hydraulic and mechanical means in order to hold the outlet valves partially open in a specifically intended manner, at least also during the compression stroke.

BRIEF DESCRIPTION OF THE INVENTION

An object of the invention is to provide a method and an engine braking device that increases the engine braking power of a combustion engine of the type in question having exhaust turbocharging compared to the prior art, wherein the temperature loading of the combustion engine in the engine braking mode should be kept as low as possible.

The object is achieved according to one embodiment of the invention by a method for controlling an engine braking device for a combustion engine in motor vehicles, in particular in commercial vehicles, which device has an intake system, an exhaust system, gas exchange valves associated with the combustion engine, in particular gas exchange valves operated according to the four-stroke principle, a fuel injection device, which injects fuel into at least one combustion chamber, exhaust turbocharging by at least one exhaust turbocharger integrated into the exhaust system and the intake system, and an engine braking unit, wherein the engine braking unit has a decompression brake, which influences at least one outlet valve of the gas exchange valves, and a brake flap, which is arranged in the exhaust system and causes the exhaust gas to build up. According to the invention, the proposal is that, as engine braking starts or during engine braking, fuel is injected into the at least one combustion chamber or into the combustion chambers of the combustion engine for a predefined period of time, in particular for a short time.

Overall, this measure according to the invention leads to an increase in the engine braking power, this being attributable to the fact that the boost pressure in the intake system of the combustion engine rises progressively and rapidly owing to the higher exhaust gas energy in the exhaust system or at the exhaust turbine of the exhaust turbocharger, thus increasing the gas mass flow through the combustion engine. On the one hand, this causes the increase in braking power, in particular by the decompression brake used, and, on the other hand, leads to greater heat dissipation in the combustion engine via the exhaust system.

According to a particularly preferred embodiment, injection of the fuel can be controlled in accordance with a boost pressure prevailing in the intake system downstream of a compressor of the exhaust turbocharger.

In particular, it is possible for injection to start only after a defined lower boost pressure threshold value is reached, in order to input the injection when the exhaust turbine of the exhaust turbocharger has already reached an operating point with a favourable efficiency (efficient fuel usage with low consumption). Here, the lower boost pressure threshold value is particularly preferably greater than or equal to 0.5 bar (relative to the environment), most preferably greater than or equal to 1.0 bar (relative to the environment).

Moreover, the duration of injection can be limited by the attainment of a defined upper boost pressure threshold value. The upper boost pressure threshold value is particularly preferably specified in such a way that injection is set at the latest on or temporally prior to attainment of the maximum boost pressure (PLmax) that can be achieved at the instantaneous operating point. Provision is particularly preferably made for injection to be set prior to attainment of the maximum boost pressure that can be achieved at the instantaneous operating point of the combustion engine since, on the one hand, the boost-pressure-increasing effect can continue to act and, on the other hand, possible boost pressure fluctuations in different combustion engines can be taken into account. By way of example, the upper boost pressure threshold value for setting injection temporally prior to attainment of the maximum boost pressure (PLmax) that can be achieved at the instantaneous operating point is specified as follows: PLmax—0.3 to 0.7 bar, in particular PLmax—0.5 bar.

As an alternative or in addition, injection of the fuel can be controlled within a time limit, i.e., the duration of injection can be time-limited, in order to prevent long injection phases possibly leading to increased fuel consumption in the event of slow boost pressure rises or unfavourable operating states of the combustion engine. The duration of injection is limited to a maximum of 30 seconds, preferably to a maximum of 20 seconds, for example.

For reasons connected with ride comfort, it may furthermore be advantageous if the injection quantity is throttled back linearly and/or continuously towards the value zero in the manner of a ramp function, based on the start of injection or a defined time period after the start of injection.

As a particularly advantageous option, the fuel injection quantity can correspond substantially to the injection quantity in the idling mode of the combustion engine. It is thereby possible to achieve a satisfactory boost pressure increase in the engine braking mode with only slight additional fuel consumption and adequate exhaust emission figures.

In an advantageous development of the method, the injection point during engine braking can be modified relative to regular fuel injection, in particular in a range of from 15° to 30° of crank angle before TDC of the respective piston during the compression stroke of the combustion engine, in order to achieve particularly favourable boost pressure rises with low fuel consumption and high engine braking power.

An engine braking device according to the invention for a combustion engine in motor vehicles has an intake system, an exhaust system, gas exchange valves associated with the combustion engine, in particular gas exchange valves controlled according to the four-stroke principle, a fuel injection device, which injects fuel into at least one combustion chamber, exhaust turbocharging by at least one exhaust turbocharger integrated into the exhaust system and the intake system, and an engine braking unit, wherein the engine braking unit has a decompression brake, which influences at least one outlet valve of the gas exchange valves, and a brake flap, which is arranged in the exhaust system and causes the exhaust gas to build up. According to the invention, an open-loop and/or closed-loop control device which controls fuel injection, in particular an electronic control unit, is provided, which brings about fuel injection for a predefined period of time during the engine braking mode when an engine braking signal is present.

The advantages obtained with this engine braking device are obtained in a manner similar to the advantages already acknowledged above in connection with the procedure according to the invention. To this extent, attention is drawn to the statements made above.

A particularly preferred option here is an embodiment in which the brake flap is arranged upstream of an exhaust turbine, preferably directly upstream of and adjacent to an exhaust turbine of the exhaust turbocharger, and is designed as a flow guiding flap which influences the admission of a gas flow through the exhaust turbine. It is thereby possible, virtually without additional outlay in terms of construction, to greatly increase the inlet-side boost pressure in the engine braking mode and thus to increase the mass flow required in the combustion engine for the achievable braking power. The brake flap thus performs several functions simultaneously: it ensures, preferably under closed-loop control, a sufficient exhaust gas backpressure and additionally ensures advantageous inflow to the turbine with a reduced exhaust gas flow rate and lower exhaust gas enthalpy, similarly to the operation of a control flap on exhaust turbines with variable turbine geometry.

More specifically, in contrast to a brake flap arranged downstream of the exhaust turbine, the brake flap arranged upstream of the exhaust turbine (in particular a brake flap arranged directly upstream of and adjacent to the exhaust turbine) here brings about a higher pressure gradient across the exhaust turbine, as a result of which, due to the higher mass flow and volume flow which is then possible through the exhaust turbine, the boost pressure and the exhaust gas backpressure can be significantly increased and thus also the engine braking power can be significantly increased in a functionally reliable manner without thermal overloading of the combustion engine. By virtue of the pressure gradient across the brake flap arranged upstream, lower loading of the exhaust turbine is achieved here for the same exhaust gas backpressure, and hence this leads to the desired increase in braking power with an increase in the exhaust gas backpressure, without higher loading of the exhaust turbine.

As a particularly preferred option, provision is made here for the brake flap to be arranged upstream of and outside, preferably directly upstream of and outside, a turbine housing of an exhaust turbine of the exhaust turbocharger (and therefore upstream of an inflow duct of the turbine housing). Through the arrangement of the at least one brake flap upstream of and hence outside a turbine housing or an inflow duct of the exhaust turbine, the flap does not form a component of the exhaust turbine, this resulting in positioning of the brake flap for easy assembly with increased degrees of freedom in terms of design. In particular, it is then possible here to avoid structural modifications to the exhaust turbine, and there is no need to stock a large number of different turbines for different model series. According to a specific first embodiment that is particularly preferred for this purpose, the exhaust turbine, in particular a turbine housing of the exhaust turbine, can then be coupled fluidically here to an exhaust manifold, to which the exhaust gas is admitted via at least one, preferably a plurality of, cylinders of the combustion engine, wherein a separate module having the brake flap is installed between the exhaust turbine and the exhaust manifold, in particular between a turbine housing of the exhaust turbine and the exhaust manifold and hence directly upstream of and outside a turbine housing of the exhaust turbine, the module being firmly connected both to the turbine housing and to the exhaust manifold. In a manner which is particularly compact and advantageous in terms of construction, provision is made, according to a second specific variant embodiment, for the exhaust turbine or an exhaust turbine housing of the exhaust turbocharger to be mounted directly on an exhaust manifold, to which the exhaust gas is admitted via at least one, preferably a plurality of, cylinders of the combustion engine, wherein the brake flap is arranged in the region of the exhaust manifold and hence directly upstream of and outside a turbine housing of the exhaust turbine.

The term "brake flap" used in the application should expressly be understood in a broad and comprehensive sense and is not limited only to pivotable flap arrangements. Thus, where not explained otherwise, the term "brake flap" is also expressly intended to include any other suitable and/or non-pivotable throttling devices, e.g., slides or rotary slides.

As regards the advantages obtained by the vehicle according to the invention, attention is likewise drawn to the remarks made above.

BRIEF DESCRIPTION OF THE DRAWINGS

An illustrative embodiment of the invention is explained below more specifically with further details. In the drawings.

DETAILED DESCRIPTION OF THE PREFERRED EMBODIMENTS

Figure 1:
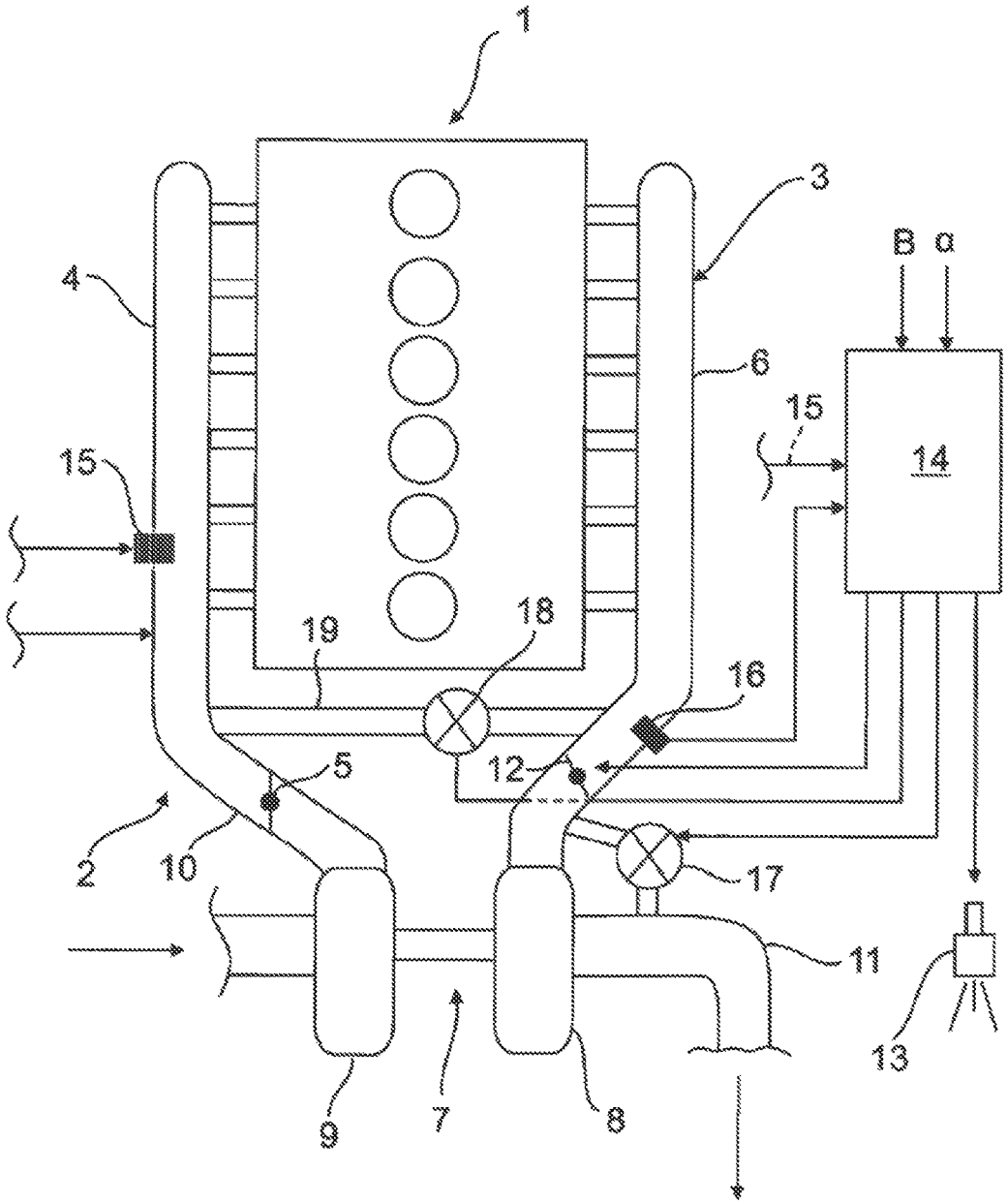
FIG. 1 shows, in a purely schematic illustration, a combustion engine for a commercial vehicle, having an intake system, an exhaust system, a fuel injection device, an exhaust turbocharger and an engine braking device having a brake flap upstream of the exhaust turbine, wherein the devices are controlled by an electronic engine control unit.

A combustion engine 1 (e.g., a six-cylinder diesel combustion engine) for a motor vehicle, in particular for a commercial vehicle, having an intake system 2 and an exhaust system 3 (of conventional construction where not described) is shown in a purely schematic way in FIG. 1. A throttle valve 5 can optionally be provided in the intake manifold 4 of the intake system 2.

The exhaust system 3 has an exhaust manifold 6, which is connected to the combustion chambers of the combustion engine 1 and is connected directly or indirectly to the exhaust turbine 8 of an exhaust turbocharger 7. The exhaust turbine 8 drives a compressor 9 in a known manner, the compressor being connected, in turn, to the intake manifold 4 by a line 10 and delivering combustion air at a defined boost pressure PL to the combustion chambers of the combustion engine 1. The exhaust gas flowing out via the exhaust manifold 6 and the exhaust turbine 8 is carried away further by an exhaust line 11. The other lines of the intake system 2 and of the exhaust system 3 of the combustion engine 1 in the motor vehicle are not shown.

As an engine braking device, the combustion engine 1 has a decompression brake (not shown), which acts on the gas exchange valves or outlet valves of the combustion engine 1. A brake flap 12, by which a defined exhaust gas backpressure PA can be produced, is furthermore provided upstream of the exhaust turbine 8.

The decompression brake can be initiated in a known manner under gas control by the increased exhaust gas backpressure PA when the brake flap 12 is at least partially closed, at which pressure "fluttering" or "valve jumping" of the outlet valves is selectively triggered (e.g. U.S. Pat. No. 8,225,769 B2), or mechanical-hydraulic opening of the outlet valves (positive control), superimposed on the valve gear, during the compression stroke of the combustion engine, can be controlled (cf U.S. Pat. No. 5,150,678).

The decompression brake of the present application may include the decompression brake as described in U.S. Pat. No. 8,225,769 B2 or U.S. Pat. No. 5,150,678.

The combustion engine 1 is furthermore provided with a fuel injection device, the injection nozzles 13 of which (only one injection nozzle 13 is indicated for the sake of simplicity) inject fuel into the combustion chambers of the combustion engine 1 in a known manner.

The fuel injection device is operated using the common rail system with electrically actuated injection nozzles 13 that feed in fuel under the control of an electronic control unit 14.

In the control unit 14, the relevant operating parameters detected by sensors, e.g., vehicle speed, engine speed, temperature, and load demand a, are logically combined, and the respectively required injection quantity is calculated and controlled.

Arranged in the intake manifold 4, there is furthermore a boost pressure sensor 15 that detects the boost pressure PL and feeds the detected boost pressure PL to the engine control unit 14 via a signal line. A pressure sensor 16, which measures the exhaust gas backpressure PA and the values from which are likewise passed to the control unit 14 via a signal line, is furthermore inserted in the exhaust manifold 6.

The control unit 14 is furthermore supplied with a signal B, which corresponds to initiation of an engine braking process in the overrun mode of the commercial vehicle. The signal can be output by a corresponding switch or of an engine braking management system (not shown) controlling a variable engine braking power.

In addition to fuel injection, the control unit 14 can optionally also control a bypass valve 17, provided purely as an option, on the exhaust turbine 8 of the exhaust turbocharger 7 and/or an exhaust gas recirculation valve 18, provided purely as an option, in a line 19 arranged between the intake system 2 and the exhaust system 3, based on operation-specific stipulations relating to the engine power and to exhaust emissions.

Apart from the known functions, the electronic control unit 14 is modified in such a way that, when the overrun mode is detected and there is an engine braking signal B, it closes the brake flap 12 to a greater or lesser extent in a predetermined manner and furthermore controls an auxiliary fuel injection in a defined quantity (in accordance with the instantaneous operating point of the combustion engine 1).

In this case, the injection quantity can be of the order of the idling quantity of the combustion engine 1 and can be controlled for only a brief period in accordance with the boost pressure PL in the intake manifold 4 and, if appropriate, in accordance with the exhaust gas backpressure PA. The duration of the auxiliary injection can be up to 30 seconds.

The injection quantity, the injection point and the injection duration are matched to one another in such a way that there is a barely detectable increase in fuel consumption and exhaust emissions with an optimum boost pressure buildup.

It has proven particularly advantageous if the auxiliary injection starts only above a certain boost pressure PL of, for example, >0.5 bar (relative to the environment), because it is only then that a relatively efficient rise in the boost pressure PL and, in association therewith, a high engine braking power can be observed. This "starting boost pressure" also ensures favourable ignition conditions for the injected fuel.

The duration of the auxiliary injection in the engine braking mode is limited at the outside by the attainment of the boost pressure which can be achieved in constant braking at the current operating point of the combustion engine 1. However, the preferred proposal is to abort the auxiliary injection at a relatively low boost pressure PL (e.g. PLmax—0.5 bar). It is thereby possible to avoid overshoots in the boost pressure profile and to suppress possible boost pressure fluctuations in different combustion engines 1.

The time duration of the auxiliary injection in the engine braking mode can be limited (e.g., to 20 seconds) to avoid long injection phases leading to an unwanted rise in fuel consumption in the case of slow boost pressure rises at unfavourable operating points of the combustion engine 1.

For reasons of comfort, it may furthermore be advisable to throttle back the auxiliary injection smoothly towards zero by a ramp function.

Moreover, the injection point during the auxiliary injection in the engine braking mode can preferably be during the respective compression stroke of the combustion engine 1, wherein the best results have been achieved in the range of from 15° to 30° of crank angle before TDC of the respective piston.

Figure 2:
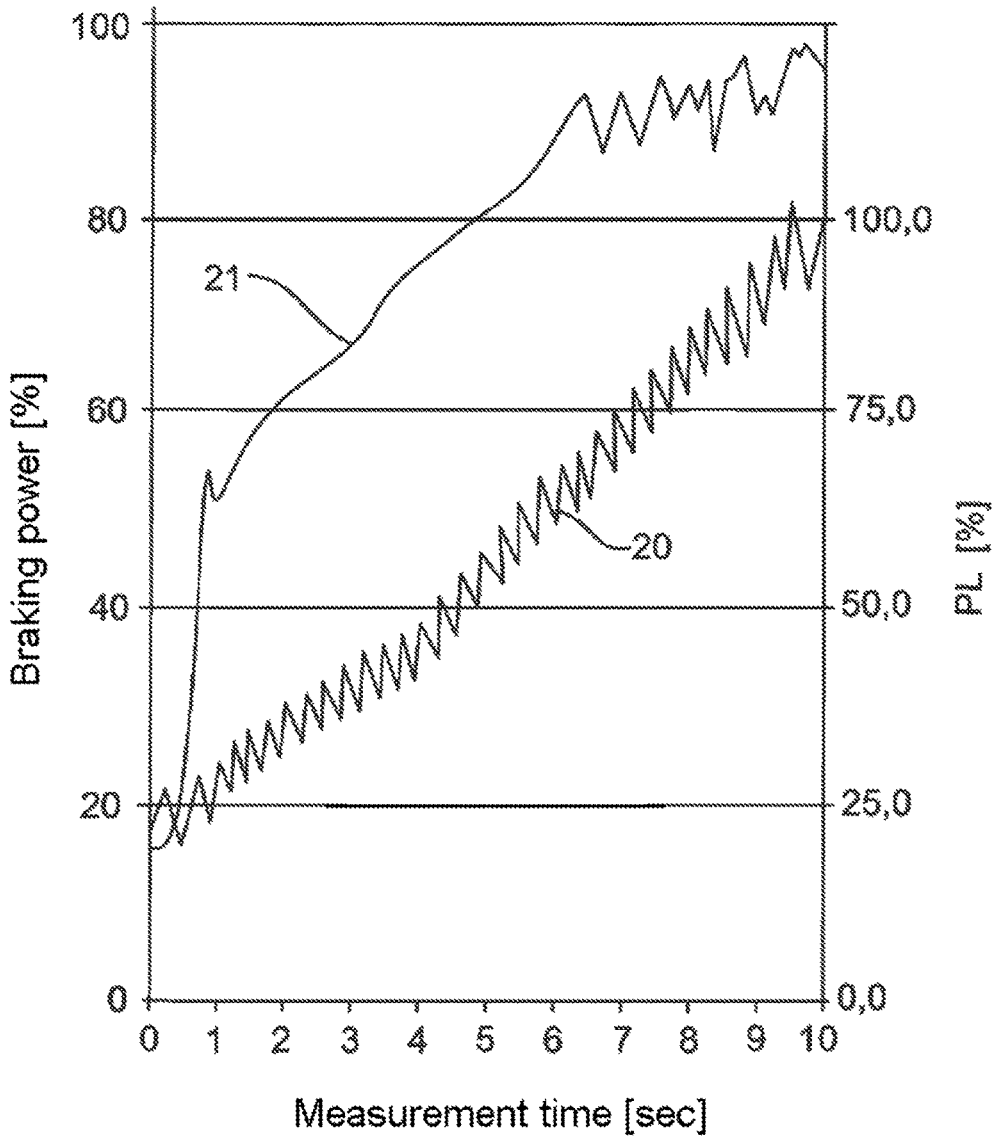
FIG. 2 shows a diagram relating to the engine braking power which can be achieved with the engine braking device according to FIG. 1 and to the boost pressure PL, plotted against a defined measurement time in the engine braking mode.

In this regard, FIG. 2 shows a diagram which illustrates the effect of the auxiliary injection described on the boost pressure profile PL and hence on the braking power of the combustion engine 1 over the measurement time between 0 (onset of engine braking) and 10 seconds, for example.

Here, measurement curve 20 describes the conventional braking power in percent as a function of the boost pressure buildup, while measurement curve 21, situated above it, indicates the boost pressure buildup and the achievable engine braking power when an auxiliary injection is carried out.

As can readily be seen from measurement curves 20, 21, the additional auxiliary fuel injection in the engine braking mode gives rise to a boost pressure profile with an initially very steep gradient, which can reach an engine braking power, which rises in a similar fashion, up to virtually 100%. In this case, the boost pressure PL may even briefly go beyond 100% of the system-related configuration.

Although the measured values were determined on a combustion engine 1 having a gas-pressure-controlled decompression brake, they are also relevant to combustion engines 1 with exhaust turbocharging and the use of a positively controlled decompression brake.

LIST OF REFERENCE SIGNS

1 combustion engine
2 intake system
3 exhaust system
4 intake manifold
5 throttle valve
6 exhaust manifold
7 exhaust turbocharger
8 exhaust turbine
9 compressor
10 intake line
11 exhaust line
12 brake flap
13 injection valve
14 control unit
15 pressure sensor
16 pressure sensor
17 bypass valve
18 exhaust gas recirculation valve
19 line
20 measurement curve without auxiliary injection
21 measurement curve with auxiliary injection

The invention claimed is:

1. A method for controlling an engine braking device for a combustion engine in a motor vehicle, the engine braking device comprising an intake system, an exhaust system, gas exchange valves, a fuel injection device that injects fuel into at least one combustion chamber, an exhaust turbocharger integrated into the exhaust system and the intake system, and an engine braking unit, wherein the engine braking unit has a decompression brake, which influences at least one outlet valve of the gas exchange valves, and a brake flap, which is arranged in the exhaust system and causes the exhaust gas to build up, the method comprising the steps of:

initiating engine braking using the engine braking unit; and as the engine braking starts or during the engine braking, injecting fuel into at least one combustion chamber of the combustion engine for a predefined period of time, wherein the step of injecting fuel is controlled in accordance with a boost pressure prevailing in the intake system downstream of a compressor of the exhaust turbocharger, and the step of injecting is initiated only after a lower boost pressure threshold value is reached or exceeded.

2. The method according to claim 1, wherein the vehicle is a commercial vehicle.

3. The method according to claim 1, wherein the lower boost pressure threshold value is greater than or equal to 0.5 bar relative to the environment.

4. The method according to claim 1, wherein the lower boost pressure threshold value is greater than or equal to 1.0 bar relative to the environment.

5. The method according to claim 1, wherein a duration of injection in the step of injecting is limited by the attainment of an upper boost pressure threshold value.

6. The method according to claim 5, wherein the upper boost pressure threshold value is set such that the step of injecting is set to begin at the latest on or temporally prior to attainment of a maximum boost pressure that can be achieved at an instantaneous operating point.

7. The method according to claim 6, wherein the maximum boost pressure that can be achieved at the instantaneous operating point is in the range 0.3 to 0.7 bar.

8. The method according to claim 6, wherein the maximum boost pressure that can be achieved at the instantaneous operating point is 0.5 bar.

9. The method according to claim 1, wherein a duration of injection during the step of injecting is time-limited.

10. The method according to claim 9, wherein the duration of injection is limited to a maximum of 30 seconds.

11. The method according to claim 9, wherein the duration of injection is limited to a maximum of 20 seconds.

12. The method according to claim 1, wherein an injection quantity is throttled back one of linearly and continuously towards a value zero as a ramp function, from a start of injection or from a defined time period after the start of injection.

13. The method according to claim 1, wherein a fuel injection quantity during the step of injecting corresponds substantially to an injection quantity in the idling mode of the combustion engine.

14. The method according to claim 1, wherein an injection point during engine braking is modified relative to regular fuel injection.

15. The method according to claim 14, wherein the injection point during engine braking is controlled in a range of from 15° to 30° of crank angle before TDC of a respective piston during the compression stroke of the combustion engine.

* * * * *